US010259221B2

(12) United States Patent
Iri et al.

(10) Patent No.: US 10,259,221 B2
(45) Date of Patent: Apr. 16, 2019

(54) ELEMENT SUBSTRATE, LIQUID EJECTION HEAD, AND LIQUID EJECTION APPARATUS

(71) Applicant: CANON KABUSHIKI KAISHA, Tokyo (JP)

(72) Inventors: Junichiro Iri, Yokohama (JP); Kazuhiro Ishii, Yokohama (JP); Ryo Sato, Yokohama (JP); Hiroyuki Shimoyama, Kawasaki (JP); Kazumasa Matsushita, Kawasaki (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/692,837

(22) Filed: Aug. 31, 2017

(65) Prior Publication Data

US 2018/0065367 A1 Mar. 8, 2018

(30) Foreign Application Priority Data

Sep. 5, 2016 (JP) ..... 2016-172688

(51) Int. Cl.

*B41J 2/14* (2006.01)
*B41J 2/145* (2006.01)
*B41J 2/16* (2006.01)

(52) U.S. Cl.

CPC ..... *B41J 2/14233* (2013.01); *B41J 2/145* (2013.01); *B41J 2/1618* (2013.01); *B41J 2202/20* (2013.01)

(58) Field of Classification Search

None

See application file for complete search history.

(56) References Cited

U.S. PATENT DOCUMENTS

2007/0279465 A1* 12/2007 Shindo ..... B41J 2/16523 347/89
2008/0117262 A1* 5/2008 Mori ..... B41J 2/14274 347/65

FOREIGN PATENT DOCUMENTS

JP 62-111758 A 5/1987

* cited by examiner

*Primary Examiner* — Erica S Lin

(74) *Attorney, Agent, or Firm* — Canon U.S.A., Inc. IP Division

(57) ABSTRACT

An element substrate in which a plurality of members are layered. Plates and a substrate serving as the plurality of members being layered and adhered to each other. The element substrate including a plurality of ejection ports that eject a liquid, and a plurality of supply ports that each communicate with a different ejection port. At least one of the members includes a groove that is, when viewing, from above, a surface in which the ejection ports are formed, formed between two ejection ports, each of which communicates to a different supply port.

11 Claims, 7 Drawing Sheets

ELEMENT SUBSTRATE, LIQUID EJECTION HEAD, AND LIQUID EJECTION APPARATUS

BACKGROUND OF THE INVENTION

Field of the Invention

The present disclosure relates to an element substrate that ejects a liquid, a liquid ejection head, and a liquid ejection apparatus.

Description of the Related Art

An element substrate that ejects a liquid is typically included in a liquid ejection head used in a liquid ejection apparatus, such as an ink jet printer. An element substrate including a structure in which a plurality of members are layered is known.

In a liquid ejection head disclosed in Japanese Patent Laid-Open No. 62-111758, a member including ejection ports that eject a liquid, a member including pressure chambers that retain the liquid ejected from the ejection ports, a member including liquid flow passages that are in communication with the pressure chambers, and a member that generates energy to eject the liquid are layered.

When the members described above are adhered together with an adhesive agent, typically, the adhesive agent is applied to the adhesion surface of each member and the members on which the adhesive agent has been applied are pinched and pressed. In so doing, the adhesive agent is pushed out from the adhesion surface of each member, and there are cases in which the adhesive agent that has been pushed out enters the ejection ports and the liquid flow passages and becomes cured. In such a case, a portion or all of the ejection ports and the liquid flow passages become clogged with the cured adhesive agent, effecting the flow of the liquid such that flow of liquid is retarded extremely reducing the flowing amount of liquid. As a result, there may be cases in which the desired liquid ejection volume cannot be reached.

As a measure for the above, one may conceive a method of suppressing the adhesive agent from being pushed out by restricting the application area of where the adhesive agent is applied and by restricting the application amount. However, with such a method, there may be an area with insufficient adhesion and the liquid may leak from that area. In the above case, when ejection ports that eject liquids of different colors are adjacent to each other, the liquids that have leaked from a portion near the ejection ports may come in contact with each other causing color mixing to happen. As a result, degradation in the image quality of the recorded image may occur.

Accordingly, there are many element substrates with relief grooves for releasing the adhesive agent, which has been pushed out, formed in portions around the ejection ports and the liquid flow passages. In such a type of element substrate, since it is possible of suppress the adhesive agent that has been pushed out from entering the ejection ports and the liquid flow passages, even if there is no restriction in the application area and the application amount, the flow of the liquid can be kept at a normal state.

In recent years, due to an increase in the quality and speed of recording, the element substrate is required to increase the number of ejection ports, and due to this, ejection ports are required to be disposed at a high density. However, when the election ports are disposed at a high density, the pressure chambers and the liquid flow passages need to be disposed at a high density as well, such that the gap between the adjacent pressure chambers and adjacent liquid flow passages become small, making it difficult to sufficiently form the relief grooves of the adhesive agent around the ejection ports and the liquid flow passages. Accordingly, trouble such as leakage of liquid may occur due to having difficulty in maintaining the flow of the liquid at a normal state, and due to restricting the application area and the application amount of the adhesive agent to maintain the flow of the liquid at a normal state.

SUMMARY OF THE INVENTION

Accordingly, the present disclosure provides an element substrate, a liquid ejection head, and a liquid ejection apparatus that are capable of suppressing trouble caused by an adhesive agent even when the ejection ports are disposed at a high density.

An element substrate according to an aspect of the present disclosure in which a plurality of members are layered and are adhered to each other with an adhesive agent includes a plurality of ejection ports that eject a liquid, and a plurality of supply ports, each of which communicates with a different ejection port of the plurality of ejection ports. In the element substrate, at least one of the plurality of members includes a groove formed between two of the plurality of ejection ports, each of which communicates with a different supply port of the plurality of supply ports, when viewing a surface, in which the plurality of ejection ports are formed, from above.

A liquid ejection apparatus according to an aspect of the present disclosure includes an element substrate in which a plurality of members are layered, the members being adhered to each other with an adhesive agent. In the liquid ejection apparatus, the element substrate includes a plurality of ejection ports that eject a liquid, and at least one of the plurality of members includes, when viewing, from above, a surface in which the ejection ports are formed, a groove formed between the two ejection ports ejecting a different type of liquid.

Further features of the present disclosure will become apparent from the following description of exemplary embodiments with reference to the attached drawings.

DESCRIPTION OF THE EMBODIMENTS

Figure 1:
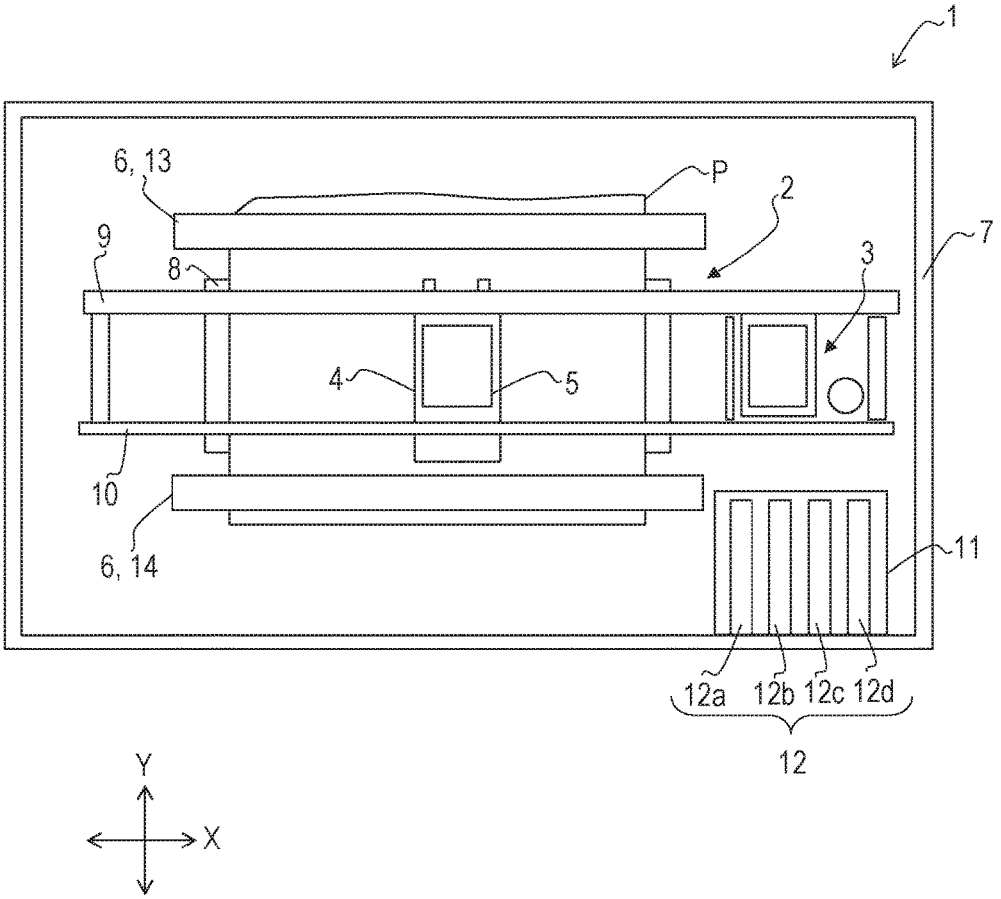
FIG. 1 is a plan view schematically illustrating a liquid ejection apparatus according to an embodiment of the present disclosure.

Hereinafter, an embodiment of the present disclosure will be described with reference to the drawings. Note that in the drawings, components that have the same function will be denoted with the same reference numeral and description thereof may be omitted.

FIG. 1 is a plan view schematically illustrating a liquid ejection apparatus according to an embodiment of the present disclosure. A liquid ejection apparatus 1 illustrated in FIG. 1 is an ink jet printer that records an image on a printing medium, such as a sheet of paper, by ejecting a plurality of colors of ink serving as a liquid. However, the liquid ejection apparatus according to the present disclosure is not limited to an ink jet printer and may applied to a typical apparatus that ejects liquid. Furthermore, in FIG. 1, the liquid ejection apparatus 1 is disposed on a horizontal surface.

As illustrated in FIG. 1, the liquid ejection apparatus 1 includes a printing unit 2 that records an image on a printing medium P, and a maintenance unit that performs maintenance on the printing unit 2.

The printing unit 2 includes a carriage 4 that reciprocally moves in a predetermined scanning direction X, a liquid ejection head 5 mounted in the carriage 4, and a conveying mechanism 6 that conveys the printing medium P in a conveyance direction Y that intersects the scanning direction X. In the present embodiment, the scanning direction X is the left-right direction in FIG. 1, and the conveyance direction Y is the front-rear direction orthogonal to the scanning direction X.

Furthermore, the liquid ejection apparatus 1 includes a housing 7, and a platen 8 that supports the printing medium P is disposed in the housing 7 in the horizontal direction. Two guide rails 9 and 10 parallel to each other are disposed in the scanning direction X above the platen 8. The carriage 4 is supported by the guide rail 9. The carriage 4 is driven by a carriage driving motor (not shown), and reciprocally moves above the platen 8 in the scanning direction X along the guide rails 9 and 10.

The liquid ejection head 5 is attached to a lower portion of the carriage 4 so as to oppose the platen 8, and ejects a liquid onto the printing medium P supported by the platen 8. A gap is provided between the liquid ejection head 5 and the platen 8.

The liquid ejection head 5 is connected, through a tube (not shown), to a holder 11 on which tanks 12 each storing a liquid that is ejected are mounted. In the example in FIG. 1, four tanks 12*a* to 12*d*, serving as the tanks 12, are mounted in the holder 11. The type of liquid retained in each of the tanks 12*a* to 12*d* may be the same or may be different. In the present embodiment, serving as the liquids of different types, liquids of four different colors, specifically, magenta, cyan, yellow, and black, are retained in the tanks 12*a* to 12*d*.

The conveying mechanism 6 includes two conveyance rollers 13 and 14 arranged parallel to each other in the front-rear direction so as to have the carriage 4 and the platen 8 therebetween. The conveyance rollers 13 and 14 are each driven by a conveyance motor (not shown), and convey the printing medium P, which is supported by the platen 8, in the conveyance direction Y.

In a printing operation that records an image by ejecting a liquid, the printing unit 2 ejects a liquid from the liquid ejection head 5 while reciprocally moving the carriage 4 in the scanning direction X. Furthermore, the printing unit 2 records the image on the printing medium P by intermittently moving the printing medium P in the conveyance direction Y in accordance with the ejection of the liquid by using the conveyance rollers 13 and 14 of the conveying mechanism 6.

Note that the liquid ejection head 5 is capable of moving not only in an area opposing the printing medium P on the platen 8 but also to the outside of the area in the scanning direction X. The present embodiment is designed such that the carriage 4 is made to standby on the right side with respect to the area opposing the printing medium P in a case in which the liquid ejection apparatus 1 is not using the liquid ejection head 5, and the liquid ejection head 5 opposes the maintenance unit 3 when the carriage 4 is at a stand-by position.

The maintenance unit 3 performs a maintenance operation that performs maintenance on the printing unit 2. The maintenance operation includes, for example, a suction operation that suctions a liquid from ejection ports (not shown in FIG. 1) that eject a liquid, and wiping that wipes off the liquid adhered to the surfaces in which the election ports of the liquid ejection head 5 are formed.

Figure 2:
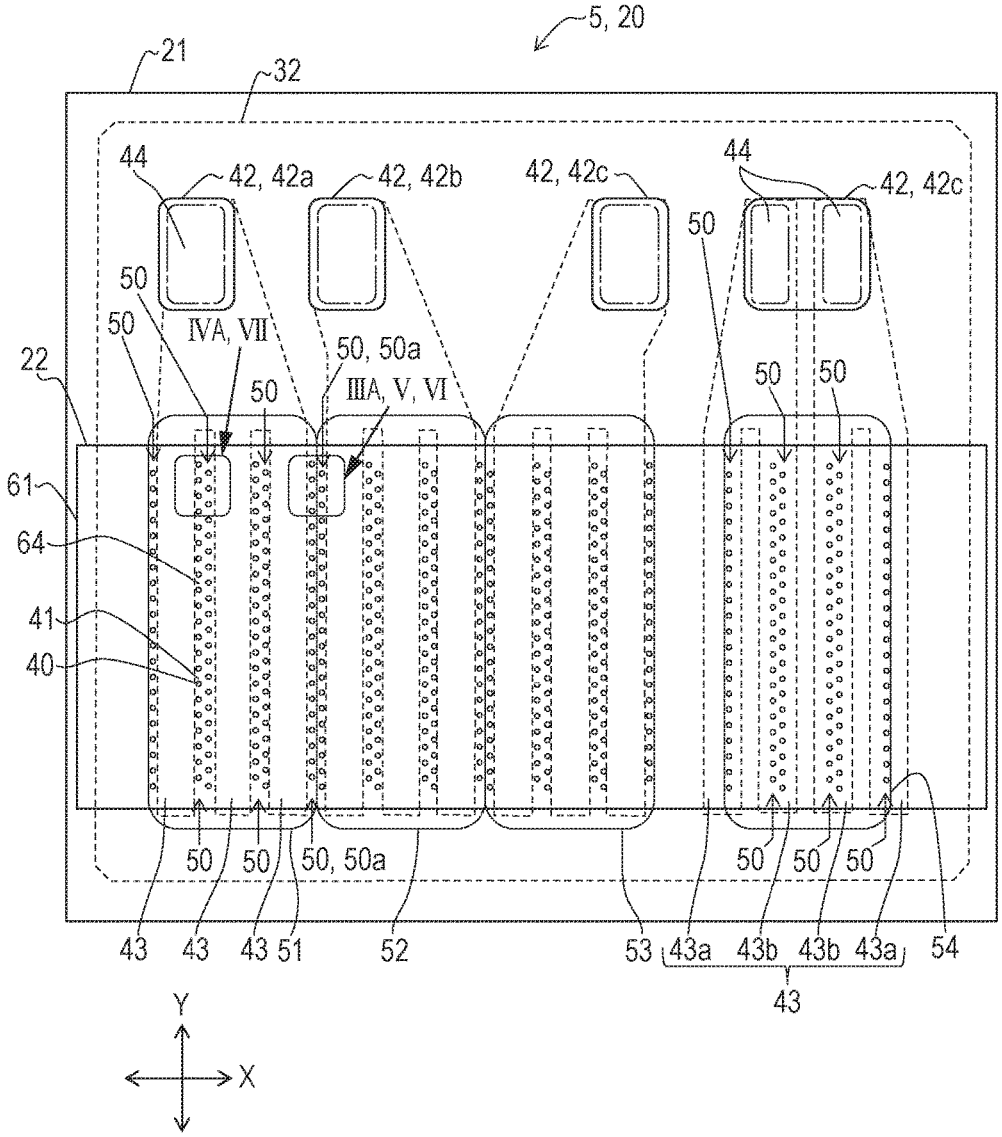
FIG. 2 is a plan view schematically illustrating a liquid ejection head used in the liquid ejection apparatus.
Figure 3A:
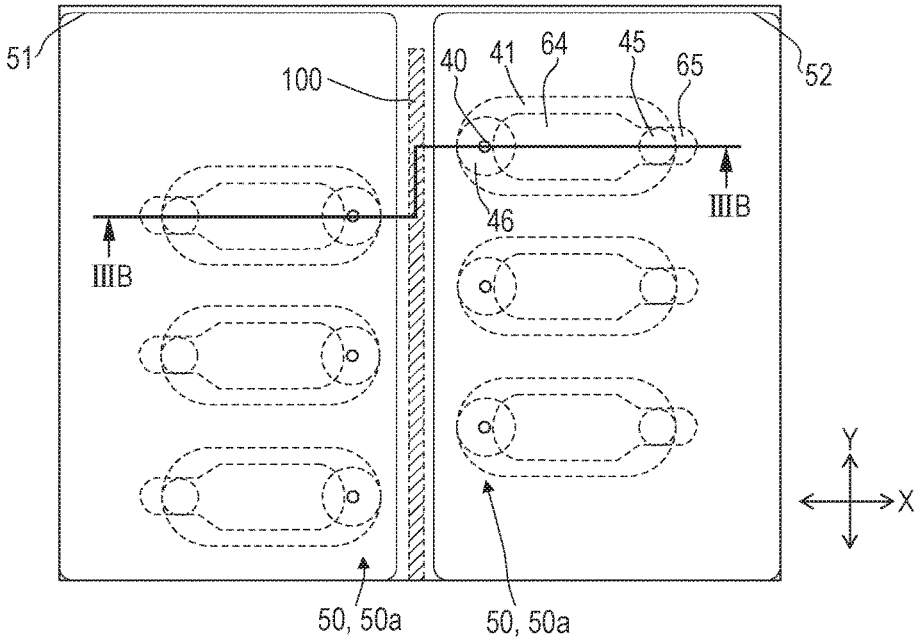
FIGS. 3A and 3B are diagrams illustrating an example of area IIIA in FIG. 2.
Figure 3B:
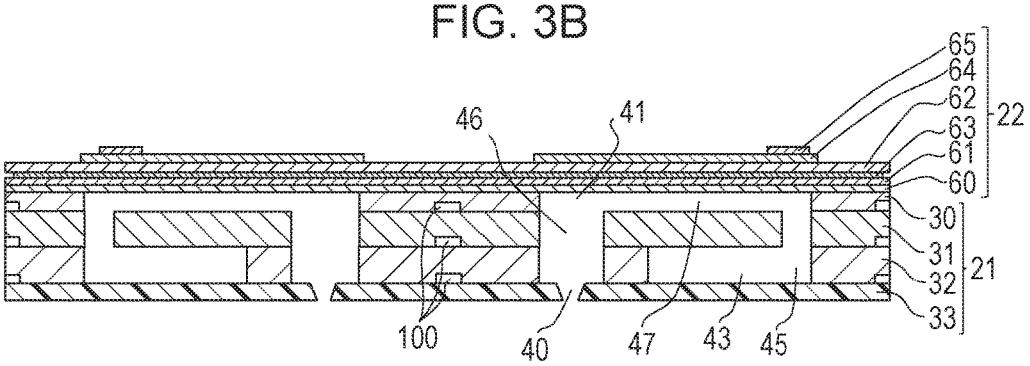
Figure 4A:
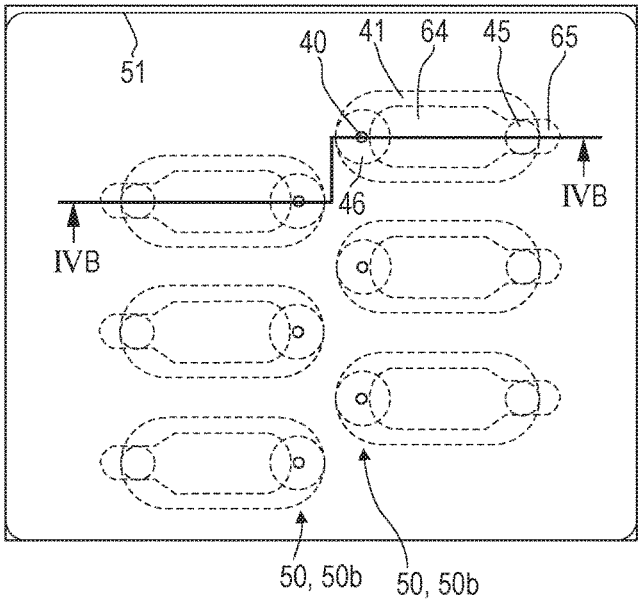
FIGS. 4A and 4B are diagrams illustrating an example of area IVA in FIG. 2.
Figure 4B:
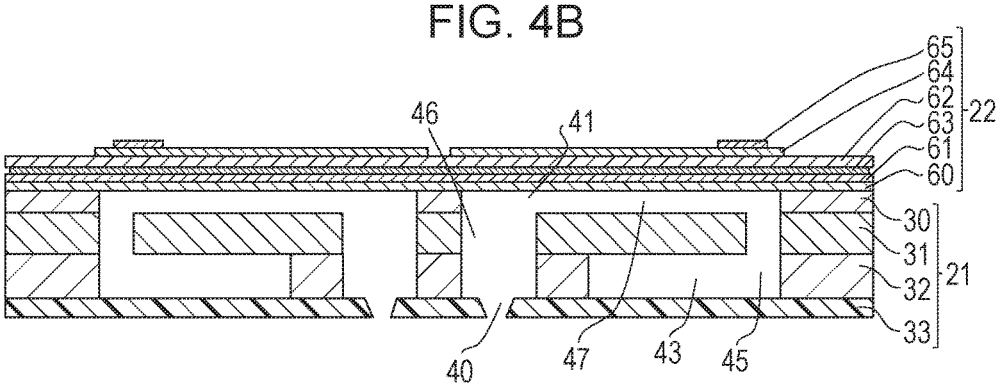

A more detailed description of the liquid ejection head 5 will be given below. FIG. 2 is a plan view schematically illustrating the liquid ejection head 5 (specifically, an element substrate 20 included in the liquid ejection head 5). FIGS. 3A and 3B are diagrams illustrating an example of area IIIA in FIG. 2, and FIGS. 4A and 4B are diagrams illustrating an example of area IVA in FIG. 2. Specifically, FIG. 3A is an enlarged view of the area IIIA, and FIG. 3B is a cross-sectional view taken along line IIIB-IIIB in FIG. 3A. FIG. 4A is an enlarged view of the area IVA, and FIG. 4B is a cross-sectional view taken along line IVB-IVB in FIG. 4A.

As illustrated in FIGS. 3B and 4B, the element substrate 20 included in the liquid ejection head 5 has a layered structure in which a plurality of members are layered. The members are adhered to each other with an adhesive agent. In the example in the drawings, the element substrate 20 has a layered structure in which a flow passage forming member 21 and a substrate 22 are layered and, further, the flow passage forming member 21 has a layered structure. Specifically, plates 30 to 33 that are four plate-shaped members are layered in the flow passage forming member 21. The plates 30 to 33 and the substrate 22 are members that constitute the layered structure of the element substrate 20.

In a state in which the liquid ejection head 5 is attached to the carriage 4 illustrated in FIG. 1, the plates 30 to 33 are layered in the up-down direction, and are disposed in the order of the plates 30, 31, 32, and 33 from the top. Hereinafter, the plates 30 to 33 may also be referred to as, from the top, a cavity plate 30, a base plate 31, a manifold plate 32, and an ejection port plate 33. The plates 30 to 33 are adhered to each other using an adhesive agent. The three plates 30 to 32 except for the ejection port plate 33 provided at the end portion (specifically, the lowermost layer) in the layered direction are formed of a metal material, such as stainless steel or a nickel alloy. The ejection port plate 33 is formed of a synthetic resin material, such as polyimide.

An ejection port array 50 in which a plurality of ejection ports 40 that eject a liquid are arranged in a predetermined direction (the conveyance direction Y in the present embodiment) at a predetermined pitch is provided in the ejection port plate 33. A plurality of ejection port arrays 50 are arranged in a parallel manner in the scanning direction X that intersects the conveyance direction Y.

A plurality of pressure chambers 41 that are arranged in the conveyance direction Y, which is the predetermined direction, at a predetermined pitch are formed in the cavity plate 30, which is the uppermost layer, in a similar manner to the arrangement of the ejection ports 40. The plurality of pressure chambers 41 constitute a pressure chamber array that corresponds to the ejection port arrays 50 and that is arranged in a parallel manner in the scanning direction X. Furthermore, as illustrated in FIG. 2, a plurality of supply ports 42 are formed at an end portion of the cavity plate 30 in the conveyance direction Y. The plurality of supply ports 42 are in communication with the tanks 12*a* to 12*d* illustrated in FIG. 1 through tubes, such that liquid is supplied from the tanks 12*a* to 12*d*. In the present embodiment, a single supply port 42 is in communication with a single tank 12. The supply ports 42 in communication with the tanks 12*a* to 12*d* may be referred to as supply ports 42*a* to 42*d*.

As illustrated in FIGS. 3B and 4B, common liquid chambers (manifold) 43 that distribute the liquid supplied to the manifold plate supply ports 42 to the pressure chambers 41 are formed.

As illustrated in FIG. 2, supply portions 44 that communicate the supply ports 42 and the common liquid chambers 43 to each other are formed in the base plate 31 and the manifold plate 32. Furthermore, as illustrated in FIGS. 3B and 4B, liquid flow passages 45 that communicate the common liquid chambers 43 and the pressure chambers 41 to each other, and liquid flow passages 46 that communicate the pressure chambers 41 and the ejection ports 40 to each other are formed in the base plate 31 and the manifold plate 32.

The pressure chambers 41, the common liquid chambers 43, the supply portions 44, the liquid flow passages 45, and the liquid flow passages 46 described above form liquid flow passages 47 that communicate the supply ports 42 and the ejection ports 40 to each other. The liquid supplied to the supply ports 42 reaches the ejection ports 40 after flowing through the supply portions 44, the common liquid chambers 43, the liquid flow passages 45, the pressure chambers 41, and the liquid flow passages 46 of the liquid flow passages 47 in this order.

In the present embodiment, the supply ports 42 each communicate with the ejection ports 40 of a different ejection port array 50, such that a single supply port 42 is in communication with a single tank 12. Furthermore, liquids of different colors are retained in the tanks 12*a* to 12*d*. Accordingly, the ejection port arrays 50 constitute a plurality of ejection port array groups ejecting liquids of different colors from the corresponding ejection ports 40. In the example in FIG. 2, four ejection port array groups 51 to 54 each constituted by six rows of ejection port arrays 50 are formed. The ejection port array group 51 ejects a magenta liquid, the ejection port array group 52 ejects a yellow liquid, the ejection port array group 53 ejects a cyan liquid, and the ejection port array group 54 ejects black liquid.

Furthermore, regarding the configuration of the common liquid chambers 43 inside the liquid flow passages 47 that communicate the supply ports 42 and the ejection ports 40 to each other, the configuration of the common liquid chambers 43 of the ejection port array groups 51 to 53 is different from the configuration of the common liquid chambers 43 of the ejection port array group 54. In each of the ejection port array groups 51 to 53, three common liquid chambers 43 that each extend in the conveyance direction Y are arranged in a parallel manner in the scanning direction X. Each common liquid chamber 43 is provided between two adjacent ejection port arrays 50, and is in communication with the ejection ports 40 included in the two ejection port arrays 50 that are positioned on both sides thereof.

Furthermore, in the ejection port array group 4, four common liquid chambers 43 that each extend in the conveyance direction. Y are arranged in a parallel manner in the scanning direction X. Among the four common liquid chambers 43, two common liquid chambers 43*a* are provided outside the ejection port arrays 50 that are provided at the two ends of the ejection port array group 54 in the scanning direction X, and are in communication with the ejection ports 40 included in the ejection port arrays 50 provided at the two ends. Furthermore, among the four common liquid chambers 43, two common liquid chambers 43*b* different from the common liquid chambers 43*a* are provided between two adjacent ejection port arrays 50 other than the ejection port arrays 50 provided at the two ends of the ejection port array group 54 in the scanning direction X. Each common liquid chamber 43*b* is in communication with the ejection ports 40 included in the corresponding two ejection port arrays 50 positioned on both sides thereof.

The area IIIA illustrated in FIG. 3A is an area including ejection ports 40 in communication with different supply ports 42, and is an area in which two adjacent ejection port arrays 50, in other words, two adjacent ejection port arrays 50 ejecting liquids of different colors are provided. Furthermore, the area IVA illustrated in FIG. 4A is an area including ejection ports 40 in communication with the same supply port 42, and is an area in which two adjacent ejection port arrays 50, in other words, two adjacent ejection port arrays ejecting a liquid of the same color are provided.

As illustrated in FIG. 3A that is an enlarged view of area IIIA, relief grooves 100 of the adhesive agent adhering the plates 30 to 32 are formed as first grooves between first ejection port arrays 50*a* that are two adjacent ejection port arrays 50 that eject liquids of different colors. Note that between the two first ejection port arrays 50*a* is between the two first ejection port arrays 50*a* when viewing the surface (XY plane) from above in which the ejection ports 40 of the element substrate 20 are provided. Accordingly, the relief grooves 100 are, when viewing the XY plane from above, provided between two ejection ports 40 in communication with different supply ports 42. Accordingly, the relief grooves 100 are provided between the liquid flow passages 47 (specifically, the liquid flow passages 46) in communication with the two ejection ports. Note that the adhesive agent that has been pushed out from between the plates 30 to 33 may flow into the relief grooves 100 when adhering the plates 30 to 33 to each other, and the liquid that has leaked from around the ejection ports 40 may flow into the relief grooves 100. Accordingly, in the manufactured liquid ejection head, the adhesive is present in at least the areas on both sides of the relief grooves 100. Furthermore, there are cases in which the adhesive agent is present inside the relief grooves 100.

While it is only sufficient that a relief groove 100 is formed in at least one of the plates 30 to 33, desirably, the relief grooves 100 are formed in the cavity plate 30, the base plate 31, and the manifold plate 32. Furthermore, a relief groove 100 may be formed in the substrate 22. In the example illustrated in FIG. 3A, the relief grooves 100 are formed on a center line between the first ejection port arrays 50*a* and in a continuous manner in a straight line along the first ejection port arrays 50*a*; however, the above is merely an example and the shape and the disposition of the relief grooves 100 are not limited to the example. For example, the relief grooves 100 may be formed on a line different from the center line between the first ejection port arrays 50*a*, or may be formed as a curved line. Furthermore, the relief grooves 100 may be shaped and disposed as illustrated in FIGS. 5A, 5B, 6A, and 6B.

Figure 5A:
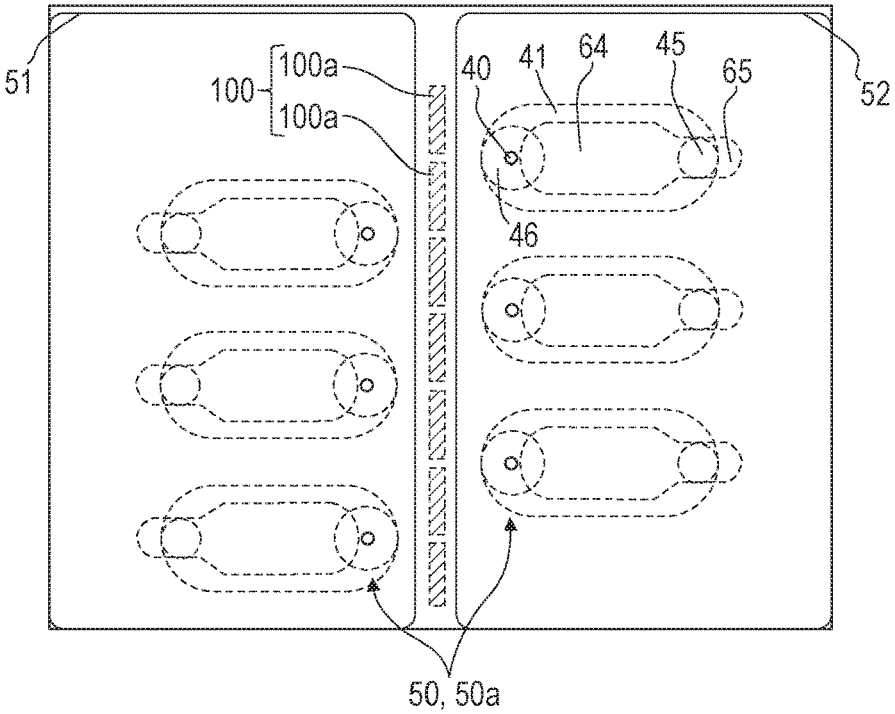
FIGS. 5A and 5B are diagrams illustrating an example of area V in FIG. 2.

In the example illustrated in FIG. 5A, while the relief grooves 100 are, similar to the example illustrated in FIG. 3A, formed in a straight line along the first ejection port arrays 50*a*, different from the example illustrated in FIG. 3A, the relief grooves 100 are constituted by a plurality of grooves 100*a* that are separated from each other. The number and the length of the grooves 100*a*, the distance between the grooves 100*a* are not limited in particular.

Furthermore, the groove 100*a* may be curved or may be inclined with respect to the ejection port arrays 50*a*. In the latter case, the inclination angle of the groove 100*a* against the ejection port arrays 50*a* may be different in each groove 100*a*.

Figure 5B:
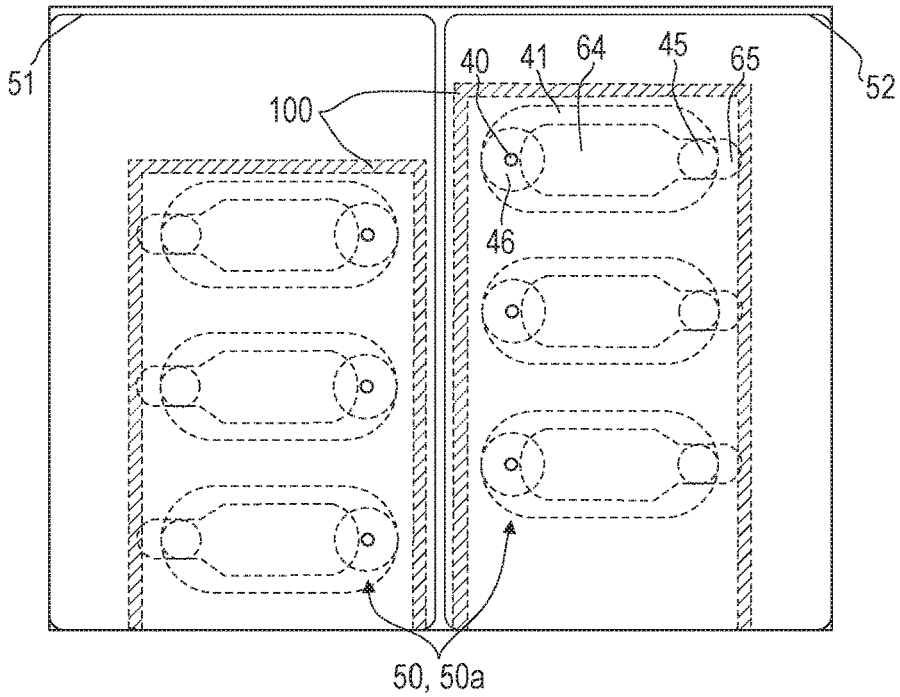

In the example illustrated in FIG. 5B, the relief grooves 100 are formed not only between the first ejection port arrays 50*a* but also to surround each of the first ejection port arrays 50*a*. The relief grooves 100 may be formed so as to surround only one of the first ejection port arrays 50*a*. Furthermore, in the example illustrated in the drawing, the relief grooves 100 are formed in a rectangular shape; however, the relief grooves 100 may be formed in other shapes, such as an elliptical shape or a rectangular shape with rounded corners.

Figure 6A:
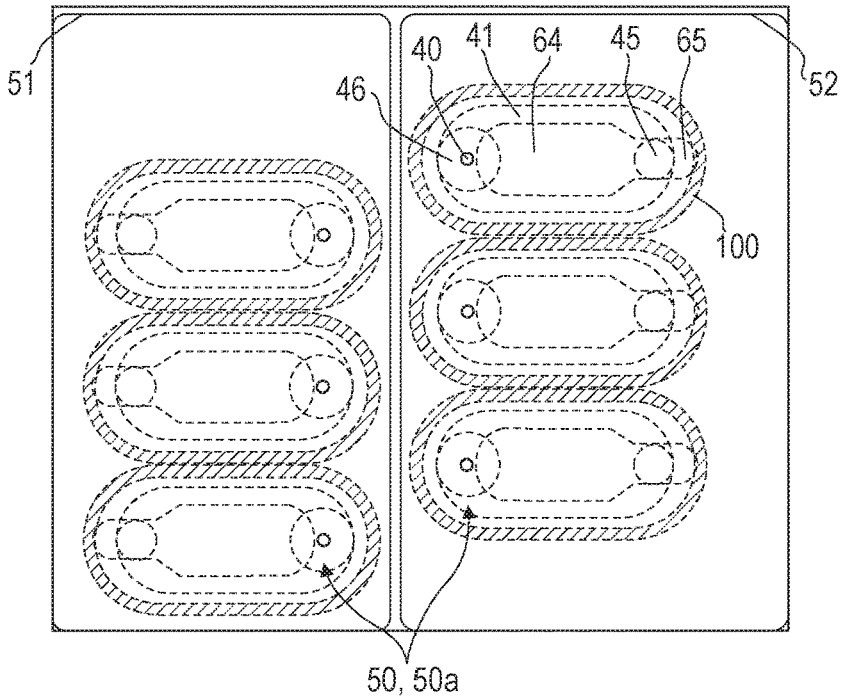
FIGS. 6A and 6B are diagrams illustrating an example of area VI in FIG. 2.

In the example illustrated in FIG. 6A, the relief grooves 100 are each formed to completely and individually surround the corresponding one of the plurality of ejection ports 40 included in the first ejection port arrays 50*a*. More specifically, each relief groove 100 is formed to surround not only the corresponding ejection port 40 but also the pressure chamber 41 in communication with the ejection port 40, and the corresponding liquid flow passage 45. Furthermore, in the example illustrated in the drawing, the relief grooves 100 are formed in a rectangular shape with rounded corners; however, the relief grooves 100 may be formed in other shapes, such as a rectangular shape or an elliptical shape.

Figure 6B:
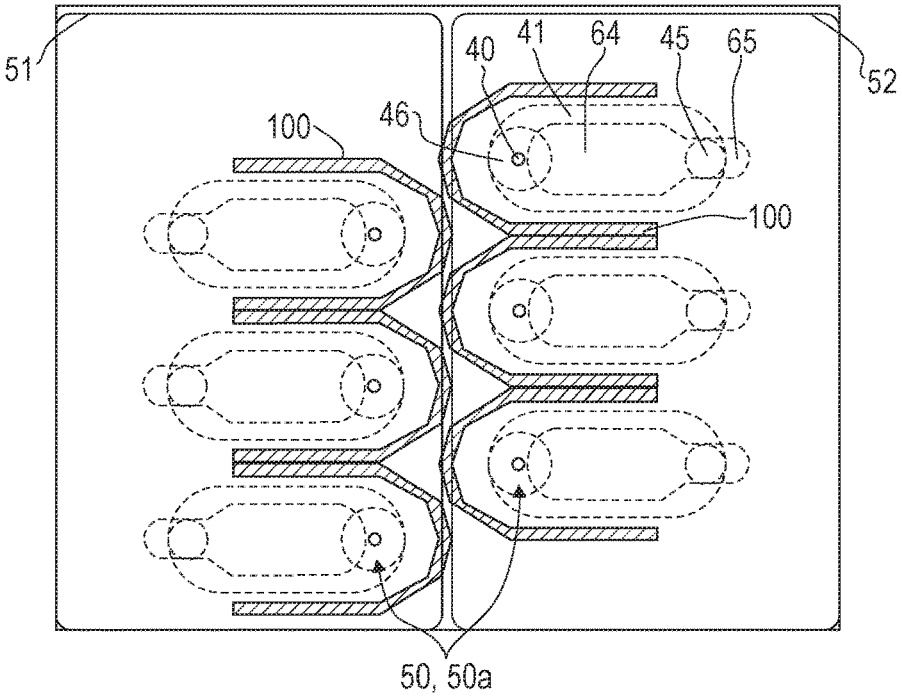

In the example illustrated in FIG. 6B, the relief grooves 100 are each formed to partially and individually surround the corresponding one of the plurality of ejection ports 40 included in the first ejection port arrays 50*a*. Specifically, the relief groove 100 is formed for each of the ejection port 40 and on at least the side of the plurality of ejection ports 40, which are included in a single first ejection port array 50*a*, in which the first ejection port arrays 50*a* are adjacent to each other. In the example illustrated in the drawing, while each relief groove 100 surrounds half or more of the corresponding pressure chamber 41, it is only sufficient that the relief groove 100 is formed only in the area between the first ejection port arrays 50*a*.

Note that in the examples in. FIGS. 5B, 6A, and 6B, each of the relief grooves 100 is a continuous groove; however, similar to the grooves 100*a* illustrated in FIG. 5A, the grooves may each be a plurality of separated grooves.

Furthermore, the first ejection port arrays 50*a* are formed at the boundary between the ejection port array group 51 and the ejection port array groups 52, the boundary between the ejection port array groups 52 and the ejection port array group 53, and the boundary between the ejection port array group 53 and the ejection port array group 54. It is only sufficient that the relief groove 100 is provided in at least one of the above boundaries. For example, the effect of color mixing on the image caused by liquids of different colors being mixed together is the strongest in a case in which yellow liquid and cyan liquid are mixed together. Accordingly, the relief groove 100 may be provided only at the boundary between the ejection port array group 52 that ejects yellow liquid and the ejection port array group 53 that ejects cyan liquid.

The relief grooves 100 may be connected to a relief groove (not shown) that is formed at another location in the same plate 30, 31, or 32. Furthermore, the relief grooves 100 of different plates 30 to 32 may be in communication with each other. For example, the relief grooves 100 of different plates 30 to 32 may be in communication with each other by providing a through hole that communicates a relief groove 100 formed in either one of the plates 30 to 32 to a relief groove 100 of another plate. Furthermore, the relief grooves 100 may be in communication with the atmosphere. In such a case, the adhesive agent can be prevented from flowing out from the relief grooves 100. Furthermore, as illustrated in FIG. 4A that is an enlarged view of area IVA, no relief grooves are formed between second ejection port arrays 50*b* that are two adjacent ejection port arrays 50 including ejection ports 40 from which liquid having the same color is ejected.

Figure 7:
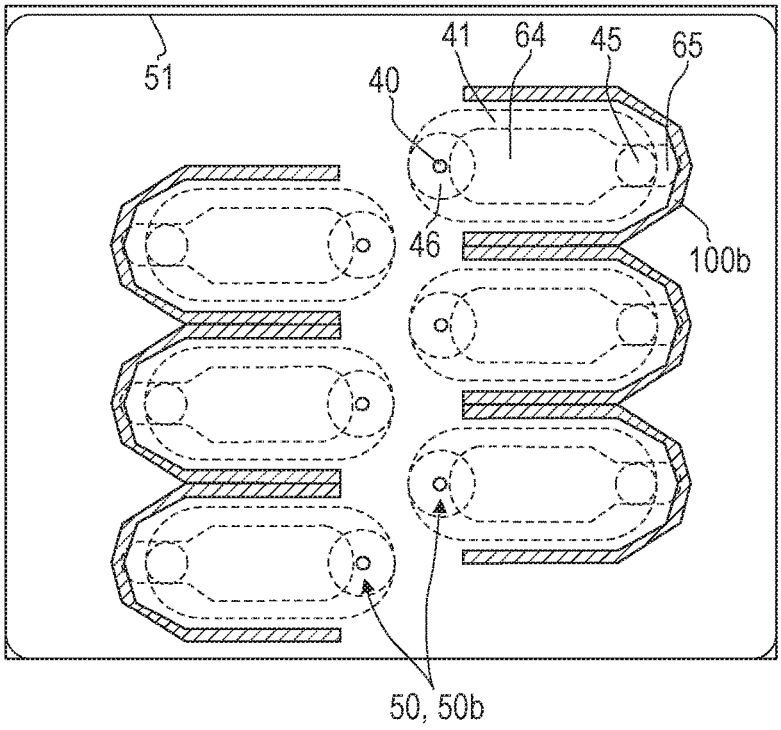
FIG. 7 is a diagram illustrating another example of area VII in FIG. 2.

In the example illustrated in FIG. 4A, although no relief grooves are formed near the second ejection port arrays 50*b*, relief grooves having formed areas that are smaller than those of the relief grooves 100 illustrated in FIGS. 3A, 5A, 5B, 6A, and 6B may be formed. The formed area is a surface area in which the relief groove 100 is formed. For example, as illustrated in FIG. 6A, in a case in which relief grooves 100 that completely surround the ejection ports 40 are formed between the first ejection port arrays 50*a*, relief grooves 100*b* illustrated in FIG. 7 may be formed between the second ejection port arrays 50*b*. The relief grooves 100*b* are second grooves that are each formed to partially and individually surround the corresponding one of the plurality of ejection ports 40 included in the second ejection port arrays 50*b*. In the example illustrated in FIG. 7, the relief grooves 100*b* are formed such that the sides of the ejection ports 40 on which the ejection port arrays 50 are adjacent to each other are open, and the side opposite the side on which the ejection port array 50 are adjacent to each other are surrounded.

Note that similar to the relief grooves 100, the relief grooves 100*b* are, desirably, formed in the cavity plate 30, the base plate 31, and the manifold plate 32. Furthermore, similar to the relief grooves 100, the relief grooves 100*b* may be connected to a relief groove (not shown) formed in another location in the same plate 30, 31, or 32, may communicate between different plates 30 to 32, or may be made to communicate with the atmosphere.

Furthermore, the cross-sectional shapes and the sizes (depths and widths) of the relief grooves 100 and 100*b* are adjusted as appropriate in accordance with the size of the element substrate 20 and the applied amount of adhesive agent.

As illustrated in FIGS. 3B and 4B, the substrate 22 includes a diaphragm 60, piezoelectric layers 61 and 62, a common electrode 63, and a plurality of individual electrodes 64.

The diaphragm 60 is a substantially rectangular metal plate and is adhered with an adhesive agent to an upper surface of the cavity plate 30 so as to cover the plurality of pressure chambers 41. The diaphragm 60 is formed of an iron based alloy, such as stainless steel, a copper based alloy, a nickel based alloy, or a titanium based alloy, for example.

Plate-shaped piezoelectric layers 61 and 62 formed across the plurality of pressure chambers 41 are layered on an upper surface of the diaphragm 60, and a common electrode 63 maintained at ground potential at all times is provided between the piezoelectric layers 61 and 62. The piezoelectric layers 61 and 62 is formed of a piezoelectric material having, for example, lead zirconate titanate (PZT), which is solid solution of lead titanate and lead zirconate, as the main component. Note that lead zirconate titanate is a ferroelectric substance. With such a configuration, the piezoelectric layers 61 and 62 are configured as piezoelectric elements that convert voltage applied to the individual electrodes 64 described later into force. In the present embodiment, the piezoelectric layer 62 is an active portion that is driven in accordance with the voltage, and the direction of polarization is oriented towards the layered direction.

A plurality of substantially elliptical plate-shaped individual electrodes 64 having a size smaller than the pressure chamber 41 are formed on an upper surface of the piezoelectric layer 62 so as to correspond to the pressure chambers 41. The plurality of individual electrodes 64 are each disposed at a position that opposes a middle portion of the corresponding pressure chamber 41. Furthermore, the individual electrodes 64 are formed of a conductive material, such as gold, copper, silver, palladium, platinum, or, titanium, for example.

A plurality of contacts 65 electrically connected to an electric wiring board (not shown) are provided at an end portion (Specifically, an area that does not oppose the pressure chambers 41) of the individual electrodes 64. Drive voltage is applied to the individual electrodes 64 from a drive circuit (not shown) mounted on the electric wiring board through the contacts 65.

When a drive voltage is applied to the individual electrodes 64, a potential difference occurs between the individual electrodes 64 and the common electrode 63 since the common electrode 63 is maintained at ground potential and, as a result, an electric field is created in the layered direction at the portion between the individual electrodes 64 and the diaphragm 60. With the above electric field, the piezoelectric layer 62 is extended towards the layered direction that is a polarization direction, and shrinks in a planar direction that is orthogonal to the layered direction. With the deformation of the piezoelectric layer 62, the portions of the diaphragm 60 that oppose the pressure chambers 41 are bent in a convex manner towards the pressure chambers 41. With the above, since the inner volumes of the pressure chambers 41 decrease, pressure is applied to the liquid retained inside the pressure chambers 41 and, as a result, an ejection energy that ejects the liquid is applied to the liquid, and the liquid is ejected from the ejection ports 40 with the ejection energy.

In each of the embodiments described above, the configurations illustrated in the drawings are merely examples and the present disclosure is not limited to the configurations.

For example, while the substrate 22 includes piezoelectric elements serving as ejection energy generating elements that apply ejection energy to the liquid, the ejection energy generating element is not limited to the piezoelectric element and may be any element that is capable of applying ejection energy to the liquid inside the pressure chambers 41.

In the present disclosure, a groove is formed between ejection ports that each communicate to a different supply port. Accordingly, when a plurality of members are adhered, the adhesive agent that has been pushed out from the members in the portion around the ejection ports, each of which communicate with a different supply port, can be released into the groove. Accordingly, by sufficient application of the adhesive agent, leakage of liquid can be prevented, such that color mixing can be prevented even when liquids of different colors are supplied to the supply ports. Furthermore, the application amount of the adhesive agent at portions other than the ejection port that each communicate to a different supply port can be suppressed, such that the adhesive agent can be prevented from entering the ejection ports or the like and being cured. Furthermore, since being in communication with the same supply port, even when a leakage of liquid caused by suppression in the application amount of the adhesive agent occurs, mixing of liquids of different colors can be suppressed. Accordingly, since trouble caused by the adhesive agent can be suppressed at portions other than the ejection port that each communicate to a different supply port even when no grooves are formed, the area for forming the groove can be reduced. Accordingly, even when the ejection ports are disposed at a high density, trouble caused by the adhesive agent can be suppressed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-172688 filed Sep. 5, 2016, which is hereby incorporated by reference herein in its entirety.

What is claimed is:

1. An element substrate in which a plurality of members are layered and are adhered to each other with an adhesive agent, the element substrate comprising:

a first supply port configured to supply a first liquid and a second supply port configured to supply a second liquid, a color of the second liquid being different from a color of the first liquid; and a first ejection port array that is an array of ejection ports from which the first liquid supplied from the first supply port is ejected and a second ejection port array that is an array of ejection ports from which the second liquid supplied from the second supply port is ejected, the second ejection port array being formed along the first ejection port array;

wherein at least one of the plurality of members layered includes a groove formed from one end to an opposite end of the first ejection port array between the first ejection port array and the second ejection port array when viewing a surface, in which the plurality of ejection ports are formed, from above.

2. The element substrate according to claim 1, wherein the groove is formed so as to surround at least one of the first ejection port arrays.

3. The element substrate according to claim 1, wherein in all of the plurality of members, a plurality of first ejection port arrays including the first ejection port array mentioned above are formed, and no grooves are formed between the plurality of first ejection port arrays.

4. The element substrate according to claim 1, wherein when viewing the surface from above, in at least one of the plurality of members, a plurality of first ejection port arrays including the first ejection port array mentioned above are formed, and a second groove that has a surface area smaller than a surface area of the groove is formed between the plurality of first ejection port arrays.

5. The element substrate according to claim 1, wherein the groove is formed in the plurality of members, and each groove formed in the plurality of members communicate with each other.

6. The element substrate according to claim 1, wherein the groove is formed by the plurality of members layered.

7. A liquid ejection head comprises:

an element substrate in which a plurality of members are layered, the members being adhered to each other with an adhesive agent, the element substrate comprising:

a first supply port configured to supply a first liquid and a second supply port configured to supply a second liquid, a color of the second liquid being different from a color of the first liquid; and a first ejection port array that is an array of ejection ports from which the first liquid supplied from the first supply port is ejected and a second ejection port array that is an array of ejection ports from which the second liquid supplied from the second supply port is ejected, the second ejection port array being formed along the first ejection port array;

wherein at least one of the plurality of members layered includes a groove formed from one end to an opposite end of the first ejection port array between the first ejection port array and the second ejection port array when viewing a surface, in which the plurality of ejection ports are formed, from above.

8. The liquid ejection head according to claim 7, wherein an adhesive agent is provided in areas on both sides of the groove.

9. The liquid ejection head according to claim 7, wherein an adhesive agent is provided inside the groove.

10. The liquid ejection head according to claim 7, the groove is formed by the plurality of members layered.

11. A liquid ejection apparatus comprising:

an element substrate in which a plurality of members are layered, the members being adhered to each other with an adhesive agent, the element substrate comprising:

a first supply port configured to supply a first liquid and a second supply port configured to supply a second liquid, the second liquid being different from the first liquid;

a first ejection port array that is an array of ejection ports from which the first liquid supplied from the first supply port is ejected and a second ejection port array that is an array of ejection ports from which the second liquid supplied from the second supply port is ejected, the second ejection port array being formed along the first ejection port array;

a carriage on which a liquid ejection head that includes the element substrate is mounted;

wherein at least one of the plurality of members layered includes a groove formed from one end to an opposite end of the first ejection port array between the first ejection port array and the second ejection port array when viewing a surface, in which the plurality of ejection ports are formed, from above.

* * * * *